US006862427B2

(12) United States Patent
Sato et al.

(10) Patent No.: US 6,862,427 B2
(45) Date of Patent: Mar. 1, 2005

(54) IMAGE FORMING APPARATUS

(75) Inventors: Mitsuhiko Sato, Chiba (JP); Hidenori Sunada, Ibaraki (JP); Hideyuki Ikegami, Chiba (JP); Satoru Yamamoto, Ibaraki (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/664,815

(22) Filed: Sep. 17, 2003

(65) Prior Publication Data

US 2004/0131407 A1 Jul. 8, 2004

(30) Foreign Application Priority Data

Sep. 18, 2002 (JP) ..... 2002-271736

(51) Int. Cl.[7] ..... G03G 15/00

(52) U.S. Cl. ..... 399/394; 399/9; 399/302; 399/388

(58) Field of Search ..... 399/9, 18, 21, 399/302, 388, 394

(56) References Cited

U.S. PATENT DOCUMENTS 6,148,172 A * 11/2000 Kanda et al. ..... 399/391
6,311,039 B1 10/2001 Funamizu et al. ..... 399/394
6,445,900 B2 * 9/2002 Fukao et al. ..... 399/302
6,795,659 B2 * 9/2004 Uchida ..... 399/9

* cited by examiner

*Primary Examiner*—Andrew H. Hirshfeld
*Assistant Examiner*—Dave A. Ghatt
(74) *Attorney, Agent, or Firm*—Rossi & Associates

(57) ABSTRACT

There is provided an image forming apparatus of the type that a toner image, which is transferred onto an intermediate transfer member, onto a sheet material, is transferred onto a sheet material, which is capable of reducing the possibility of leading end misalignment even if there is a delay in conveyance of the sheet material. An image forming device forms an image on a photosensitive member. An image carrier carries an image. A first transfer device transfers the image carried by the image carrier onto a sheet. A second transfer device transfers the image transferred onto the image carrier onto a sheet. A feeding device feeds the sheet. A conveying device conveys the sheet fed by the feeding device to the second transfer device. A controller controls the conveying device to cause the sheet to be temporarily stopped at a first location and a second location between the feeding device and the second transfer device. The controller is operable when determining that, if the sheet is caused to be temporarily stopped at the first location, the sheet cannot be conveyed to the second transfer device by the conveying device in time for timing in which the image carried by the image carrier reaches the second transfer device, for providing control to inhibit the sheet from being temporarily stopped at the first location.

10 Claims, 8 Drawing Sheets

IMAGE FORMING APPARATUS

BACKGROUND OF THE INVENTION

1. Field of the Invention

The present invention relates to an image forming apparatus that conveys a sheet material stored in a sheet tray to a transfer position and transfers an image onto the sheet material.

2. Description of the Related Art

In conventional image forming apparatuses, in conveying a sheet material such as a cut sheet stored in a sheet tray to a transfer position on a conveying path, the leading end of the sheet material is made to abut on a pair of rollers (registration rollers) disposed upstream of the transfer position so that the sheet material is corrected for skewing with respect to a direction in which the sheet material moves, and carries out timing adjustment by causing the sheet material to wait for a predetermined period of time so that the leading end of the sheet material and the leading end of an image can be aligned with each other.

Further, in the conventional image forming apparatuses, in transferring a color image onto a sheet material, a toner image on a photosensitive member is directly transferred onto the sheet material.

However, the conventional image forming apparatuses that directly transfer a toner image on the photosensitive member onto a sheet material have the problem that the transfer efficiency depends on physical characteristics of a sheet material being conveyed. To solve this problem, an image forming apparatus has been proposed which transfers a toner image on a photosensitive member onto an intermediate transfer member and transfers the toner image on the intermediate transfer member onto the sheet material.

FIGS. 8A and 8B schematically show the constructions of the above described image forming apparatuses.

FIG. 8A is a view showing an example of the image forming apparatus that directly transfers a toner image on the photosensitive member onto a sheet material, and FIG. 8B is a view showing an example of the image forming apparatus that transfers a toner image on the photosensitive member onto the intermediate transfer member and then transfers the toner image on the intermediate transfer member onto the sheet material.

In FIGS. 8A and 8B, reference numeral 101 denotes a sheet tray; 102, a pair of sheet feed rollers; 103, a pair of drawing rollers; 104, a pair of registration rollers; 105, a photosensitive drum for forming a black (K) toner image; 106, a photosensitive drum for forming a cyan (C) toner image; 107, a photosensitive drum for forming a magenta (M) toner image; 108, a photosensitive drum for forming an yellow (Y) toner image; 109, a fixing device; 120, a pick-up roller; 121, a transfer roller; 122, an intermediate transfer member; 123, a conveying belt; and P, a sheet material.

To form a color image on the sheet material P, image forming units that form respective ones of Y, M, C, and K toner images are arranged in a direction in which the sheet material P is conveyed.

Referring to FIG. 8A, a description will now be given of a process in which a color image is formed on the sheet material P.

First, the sheet material P set on the sheet tray 101 is conveyed to the pair of registration rollers 104 by the pick-up roller 120, the pair of sheet feed rollers 102, and the pair of drawing rollers 103, where the leading end of the sheet material P abuts on the pair of registration rollers 104. Then, upon the lapse of a waiting time, the pair of registration rollers 104 start rotating.

The exposure of an image on the photosensitive drum 105 for forming a K toner image is started in such timing that the leading end of the sheet material P and the leading end of the image are aligned with each other. Thereafter, images are successively exposed on the photosensitive drum 106 for forming a C toner image, the photosensitive drum 107 for forming an M toner image, and the photosensitive drum 108 for forming a Y toner image, and the images are superposed one over the other on the sheet material P conveyed by the sheet material conveying belt 123 to form a full-color image.

After the toner images are transferred onto the sheet material P, the toner images are fixed on the sheet material P by the fixing device 109 and then discharged.

Referring next to FIG. 8B, a description will be given of a process in which a color image is formed on the sheet material P.

Similarly to the image forming apparatus in FIG. 8A, the image forming apparatus in FIG. 8B is comprised of the photosensitive drums (105 to 108) for forming Y, M, C, and K toner images, the pick-up roller 120, the pair of sheet feed rollers 102, the pair of drawing rollers 103, and the pair of registration rollers 104, which are used for conveying the sheet material P set on the sheet tray 101.

Toner images transferred onto the intermediate transfer member 122 are transferred onto the sheet material P via the transfer roller 121 and then fixed by the fixing device 109.

As shown in FIG. 8B, in the image forming apparatus employing the intermediate transfer member 122, there is a long distance from the photosensitive drum 108 to the transfer roller 121, and hence a period of time in which a toner image on the photosensitive drum 108 is conveyed to the transfer roller 121 via the intermediate transfer member 122 can be longer than a period of time in which the leading end of the sheet material P is fed from the sheet tray 101 to the transfer roller 121. For this reason, the image forming apparatus of this type needs to start image exposure before starting the conveyance of the sheet material P.

However, in the case where image exposure is started before the conveyance of the sheet material P is started, if there is a delay in conveyance of the sheet material P, the problem that the leading end of the sheet material P and the leading end of the toner image are not aligned with each other, i.e. misalignment of leading ends occurs.

Therefore, it is necessary to provide control to compensate for a delay in conveyance of the sheet material P.

Conventionally, the following ways of conveyance control have been envisaged so as to compensate for a delay in conveyance of the sheet material P: (1) a period of time in which the sheet material P is conveyed over a predetermined section is measured and the measured period of time is compared with a reference period of time in which the sheet material P passes through the predetermined section, and if the period of time in which the sheet material P is conveyed is longer than the reference period of time, the conveying speed is increased; and (2) a period of time in which the sheet material P is conveyed over a predetermined section is measured and the measured period of time is compared with a reference period of time in which the sheet material P passes through the predetermined section, and image exposure start timing is delayed in accordance with a delay in conveyance, which is obtained by the comparison.

However, according to the above way of control (1), a motor for conveying the sheet material P needs to be rotated at a higher speed than the normal conveying speed, and hence it is necessary to use a motor whose driving speed can be varied in a wide range. This increases the cost of the image forming apparatus.

The above way of control (2) is useful for sheet material conveyance control by the image forming apparatus that directly transfers a toner image onto the sheet material P.

However, if the way of control (2) is applied to the image forming apparatus employing the intermediate transfer member, it is impossible to prevent leading end misalignment by compensating for a delay in conveyance of the sheet material P because image exposure has already been started before the start of conveyance.

SUMMARY OF THE INVENTION

It is an object of the present invention to provide an image forming apparatus of the type that a toner image, which is transferred onto an intermediate transfer member, is transferred onto a sheet material, which is capable of reducing the possibility of leading end misalignment even if there is a delay in conveyance of the sheet material.

To attain the above object, in a first aspect of the present invention, there is provided an image forming apparatus comprising an image carrier that carries an image, a transfer device that transfers the image carried by the image carrier onto a sheet, a feeding device that feeds the sheet, a conveying device that conveys the sheet fed by the feeding device to the transfer device, and a controller that controls the conveying device to cause the sheet to be temporarily stopped at a first location and a second location between the feeding device and the transfer device, wherein the controller is operable when determining that, if the sheet is caused to be temporarily stopped at the first location, the sheet cannot be conveyed to the transfer device by the conveying device in time for timing in which the image carried by the image carrier reaches the transfer device, for providing control to inhibit the sheet from being temporarily stopped at the first location.

According to the first aspect of the present invention, in the image forming apparatus that transfers toner images transferred on the intermediate transfer member onto a sheet material, the possibility of leading end misalignment can be reduced even if there is a delay in conveyance of the sheet material.

Preferably, the second location is a registration location, and the first location is a pre-registration location upstream of the second location.

Preferably, the image forming apparatus comprises a sheet sensor disposed in a vicinity of the first location, and the controller determines whether the sheet can be conveyed to the transfer device by the conveying device in time for the timing in which the image carried by the image carrier reaches the transfer device even if the sheet is caused to be temporarily stopped at the first location, based on timing in which the sheet sensor detects a leading end of the sheet.

Preferably, the controller is operable when determining that the sheet cannot be conveyed to the transfer device by the conveying device in time for the timing in which the image carried by the image carrier reaches the transfer device even if the sheet is conveyed without being temporarily stopped at the first location, for providing control to stop conveyance of the sheet by the conveying device or issue abnormality warning.

To attain the above object, in a second aspect of the present invention, there is provided an image forming apparatus comprising a photosensitive member, an image forming device that forms an image on the photosensitive member, an image carrier that carries an image, a first transfer device that transfers the image formed on the photosensitive member onto the image carrier, a second transfer device that transfers the image transferred onto the image carrier onto a sheet, a feeding device that feeds the sheet, a conveying device that conveys the sheet fed by the feeding device to the second transfer device, and a controller that controls the conveying device to cause the sheet to be temporarily stopped at a first location and a second location between the feeding device and the second transfer device, wherein the controller is operable when determining that, if the sheet is caused to be temporarily stopped at the first location, the sheet cannot be conveyed to the second transfer device by the conveying device in time for timing in which the image carried by the image carrier reaches the second transfer device, for providing control to inhibit the sheet from being temporarily stopped at the first location.

According to the second aspect of the present invention, in the image forming apparatus that transfers toner images transferred on the intermediate transfer member onto a sheet material, the possibility of leading end misalignment can be reduced even if there is a delay in conveyance of the sheet material.

Preferably, temporarily stopped at the first location.

Preferably, the second location is a registration location, and the first location is a pre-registration location upstream of the second location.

Preferably, the image forming apparatus comprises a sheet sensor disposed in a vicinity of the first location, and the controller determines whether the sheet can be conveyed to the second transfer device by the conveying device in time for the timing in which the image carried by the image carrier reaches the second transfer device even if the sheet is caused to be temporarily stopped at the first location, based on timing in which the sheet sensor detects a leading end of the sheet.

Preferably, the controller is operable when determining that the sheet cannot be conveyed to the second transfer device by the conveying device in time for the timing in which the image carried by the image carrier reaches the second transfer device even if the sheet is conveyed without being temporarily stopped at the first location, for providing control to stop conveyance of the sheet by the conveying device or issue abnormality warning.

Preferably, the photosensitive member comprises a photosensitive drum, and the image carrier comprises an intermediate transfer belt.

Preferably, the photosensitive member comprises a plurality of photosensitive members.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
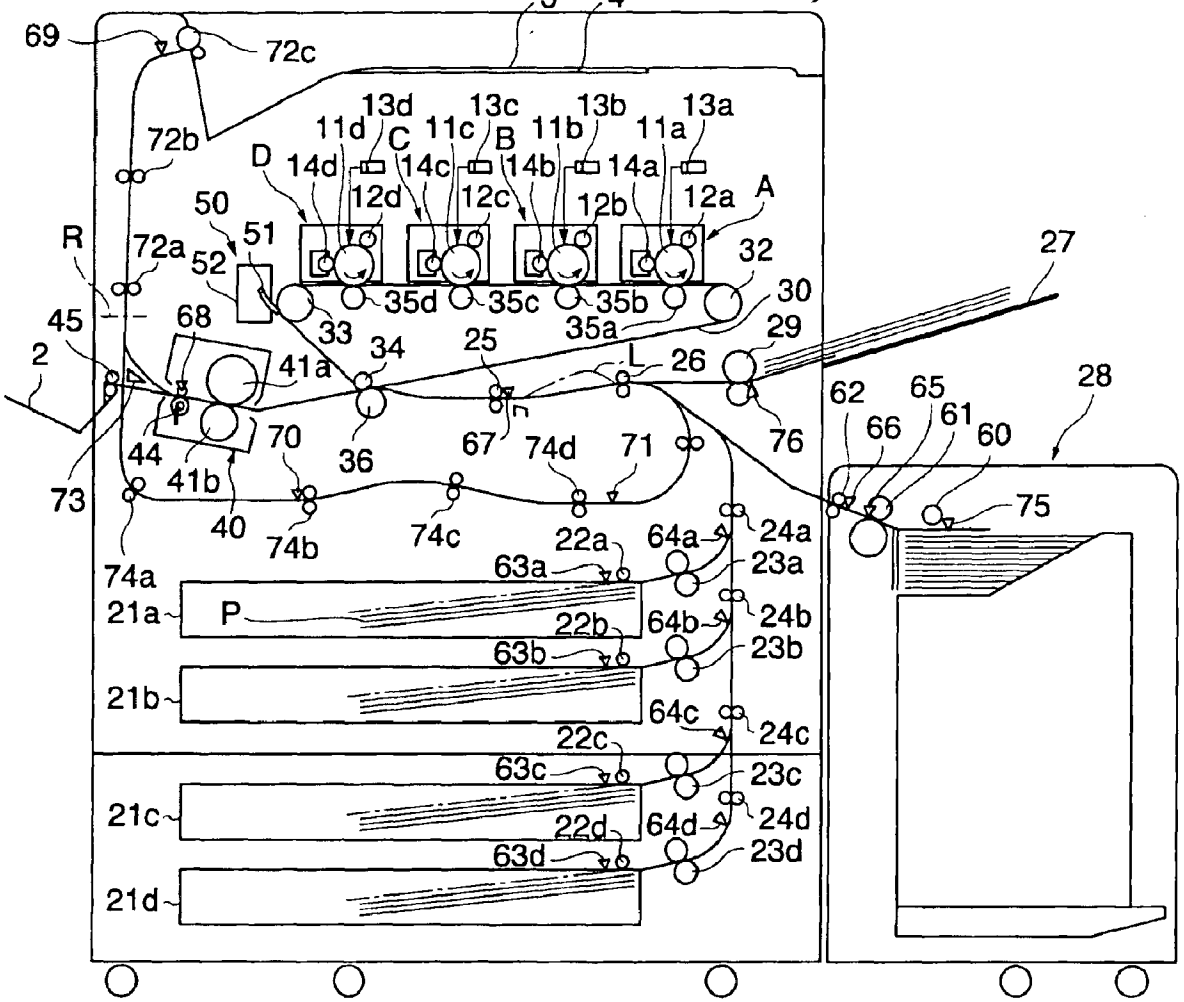
FIG. 1 is a sectional view showing the construction of an image forming apparatus according to an embodiment of the present invention.

FIG. 1 is a sectional view showing the construction of an image forming apparatus according to an embodiment of the present invention. Note that a control unit 5 is omitted from FIG. 1.

In FIG. 1, reference numeral 1 denotes an image forming apparatus; 2, a face-up discharged sheet tray; 3, face-down discharged sheet tray; 4, an operating section; 11*a*, 11*b*, 11*c*, and 11*d*, photosensitive drums as photosensitive members; 12*a*, 12*b*, 12*c*, and 12*d*, roller-type electrifiers; 13*a*, 13*b*, 13*c*, and 13*d*, laser scanners for forming electrostatic latent images on the respective photosensitive drums 11*a* to 11*d*; 14*a*, 14*b*, 14*c*, and 14*d*, developing devices for attaching toner (developing agent) to electrostatic latent images formed on the respective photosensitive drums 11*a* to 11*d* by means of the laser scanners 13*a* to 13*d*; 21*a*, 21*b*, 21*c*, and 21*d*, cassettes for storing sheet materials P; 22*a*, 22*b*, 22*c*, and 22*d*, pick-up rollers for feeding the sheet materials P sheet by sheet from the respective cassettes 21*a* to 21*d*; 23*a*, 23*b*, 23*c*, and 23*d*, pairs of sheet feed rollers; 24*a*, 24*b*, 24*c*, and 24*d*, pairs of drawing rollers; 25, a pair of registration rollers; 26, a pair of pre-registration rollers; 27, a manual feed tray; 28, a deck; 29, a pair of sheet feed rollers; 30, an intermediate transfer member formed by a belt as an image carrier; 32, a driving roller for transmitting a driving force to the intermediate transfer member 30; 33, a tension roller for applying a proper tension to the intermediate transfer member 30 by means of a spring, not shown; 34, a driven roller for forming a secondary transfer region by sandwiching the intermediate transfer member 30 between the following roller 34 and a secondary transfer roller 36, described later; 35*a* to 35*d*, primary transfer rollers to which high voltage for transferring respective toner images onto the intermediate transfer member 30 is applied; 36, the secondary transfer roller for transferring an image formed on the intermediate transfer member 30 onto the sheet material P; 40, a fixing unit; 41*a*, a fixing roller having a heat source such as a halogen heater incorporated therein; 41*b*, a pressurizing roller for pressurizing the sheet material P sandwiched between itself and the fixing roller 41*a* (the pressurizing roller 41*b* may have a heat source incorporated therein); 44, a first sheet discharging roller for conveying the sheet material P discharged from the pair of rollers consisting of the fixing roller 41*a* and the pressurizing roller 41*b*; 45, a pair of second sheet discharging rollers; 50, a cleaning device for cleaning an image carrying surface of the intermediate transfer member 30; 51, a cleaner blade made of polyurethane rubber; 52, a waste toner box for storing waste toner; 60, a pick-up roller; 61, a sheet feed roller; 62, a pair of drawing rollers; 63*a*, 63*b*, 63*c*, and 63*d*, cassette sheet detecting sensors; 64*a*, 64*b*, 64*c*, and 64*d*, sheet feed pre-registration sensors as detecting means; 65, a deck sheet feed sensor; 66, a deck drawing sensor; 67, a registration sensor; 68, a first discharged sheet sensor; 69, a face-down discharged sheet sensor; 70, a double-sided pre-registration sensor; 71, a double-sided sheet refeed sensor; 72*a*, 72*b*, and 72*c*, pairs of inversion rollers; 73, a switching flapper; 74*a* to 74*d*, pairs of double-sided sheet refeed rollers; 75, a deck sheet detecting sensor; 76, a tray sheet detecting sensor; L, a loop; and R, an inverting location.

It should be noted that the photosensitive drums 11*a* to 11*d* may be replaced by photosensitive belts, and the intermediate transfer member 30 in the form of a belt may be replaced by an intermediate transfer drum.

The pick-up rollers 22*a* to 22*d*, the pairs of sheet feed rollers 23*a* to 23*d*, the pairs of drawing rollers 24*a* to 24*d*, the pair of pre-registration rollers 26, the pair of sheet feed rollers 29, the pick-up roller 60, the sheet feed roller 61, the pair of pull-out rollers 62, and the pairs of double-sided sheet refeed rollers 74*a* to 74*d* constitute a conveying system for conveying the sheet material P along a conveying path.

The detecting means are not limited to the sheet feed pre-registration sensors 64*a* to 64*d*, but may be implemented by other types of sensors.

Figure 2:
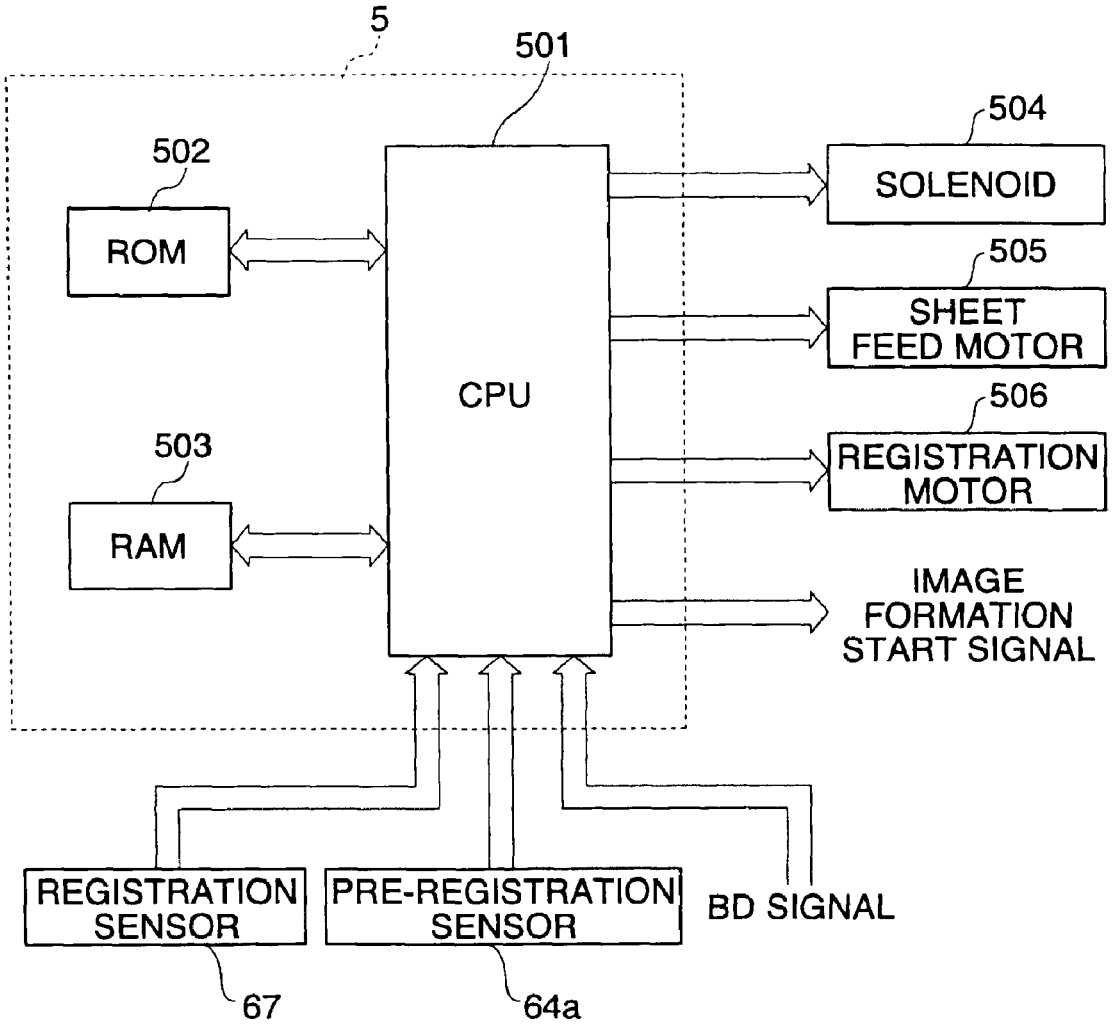
FIG. 2 is a block diagram showing the arrangement of a control unit and its related elements of the image forming apparatus 1 in FIG. 1.

The image forming apparatus 1 is comprised mainly of an image forming section (four stations A, B, C, and D, which are arranged in parallel and are identical in construction with each other), a sheet feed section, an intermediate transfer section, the conveying system, the fixing unit 40, the operating section 4, and the control unit 5 (refer to FIG. 2).

A description will now be given of the above component parts of the image forming apparatus 1.

The image forming section is comprised of the photosensitive drums 11*a* to 11*d*, the electrifiers 12*a* to 12*d*, the scanners 13*a* to 13*d*, the developing devices 14*a* to 14*d*, and the primary transfer rollers 35*a* to 35*d*.

Each of the photosensitive drums 11*a* to 11*d* is rotatably supported by a central shaft thereof, and is rotatively driven by a driving motor, not shown, in a direction indicated by an arrow in FIG. 1. At locations opposed to respective outer peripheral surfaces of the photosensitive drums 11*a* to 11*d*, the electrifiers 12*a* to 12*d*, the scanners 13*a* to 13*d*, and the developing devices 14*a* to 14*d* are arranged in this order and in a direction in which the photosensitive drums 11*a* to 11*d* are rotated.

The electrifiers 12*a* to 12*d* apply a uniform amount of electric charge to the respective photosensitive drums 11*a* to 11*d*.

Then, the scanners 13*a* to 13*d* cause a ray of light such as a laser beam, which has been modulated according to a recording image signal, to fall upon respective rotary polygon mirrors rotating at the same angular velocity, so that the surfaces of the photosensitive drums 11*a* to 11*c* are exposed by scanning light reflected from the respective rotary polygon mirrors. In this way, electrostatic latent images are formed on the respective photosensitive drums 11*a* to 11*d*.

Each of the scanners 13*a* to 13*d* has a beam detect sensor (BD sensor) that detects light reflected from the corresponding rotary polygon mirror, and counts the number of times (BD signal) a laser beam falls upon the BD sensor so that timing in which image exposure is started and timing in which the conveyance of the sheet material P is started can coincide with each other.

The scanner 13*a* for exposing an image corresponding to a black (K) toner image outputs a signal, which is obtained by frequency-dividing the BD signal by a predetermined value, to a CPU 501, described later (refer to FIG. 2).

Thereafter, the developing devices 14*a* to 14*d* visualize the above-mentioned respective electrostatic latent images using respective stored toners of four colors: yellow (Y), cyan (C), magenta (M), and black (K). The visualized images are transferred onto the intermediate transfer member 30.

By the above described process, images are successively formed on the intermediate transfer member 30. Image exposure (image formation) is started in response to output of an image formation start signal from the control unit 5 appearing in FIG. 2, described later.

The sheet feed section is comprised of a part where sheet materials P are stored, rollers for conveying the sheet materials P, sensors for detecting the passage of the sheet materials P, sensors for detecting the presence of the sheet materials P, and guides, not shown, for conveying the sheet materials P on the conveying path.

The deck 28 stores the sheet materials P.

The pick-up rollers 22*a* to 22*d* may each feed a plurality of sheet materials P simultaneously, but the plurality of sheet materials P are divided sheet by sheet by the pairs of sheet feed rollers 23*a* to 23*d*. Each of the sheet materials P thus divided is conveyed to the pair of registration rollers 25 by the corresponding pair of drawing rollers 24*a* to 24*d* and the pair of pre-registration rollers 26.

The pickup roller 22*a*, the pair of sheet feed rollers 23*a*, and the pair of drawing rollers 24*a* are driven by a sheet feed motor 505, described later. Similarly, the pick-up roller 22*b*, the pair of sheet feed rollers 23*b*, and the pair of drawing rollers 24*b* are driven by another motor, not shown.

Namely, the pick-up rollers 22, the pairs of sheet feed rollers 23, and the pairs of drawing rollers 24 are driven by different motors, not shown, assigned to the respective groups of rollers according to the alphabets a, b, c, and d added to the ends of the reference numerals.

Further, the pick-up roller 22*a* feeds the sheet material P through the cooperation of a gear and a cam in response to the operation of a solenoid 504 (refer to FIG. 2).

This also applies to the pick-up rollers 22*b* to 22*d*.

The sheet materials P stored in the manual feed tray 27 are divided sheet by sheet by the pair of sheet feed rollers 29, and each of the sheet materials P thus divided is conveyed to the pair of registration rollers 25 by the pair of pre-registration rollers 26.

A plurality of the sheet materials P stored in the deck 28 are conveyed together to the sheet feed roller 61 by the pick-up roller 60, and are divided sheet by sheet by the sheet feed roller 61. Each of the sheet materials P thus divided is conveyed to the pair of drawing rollers 62.

Further, the sheet material P is conveyed to the pair of registration rollers 25 by the pair of pre-registration rollers 26.

The pair of registration rollers 25 are driven by a registration motor 506, described later.

Further, the pair of pre-registration rollers 26 and the pair of sheet feed rollers 29 are driven by motors, not shown.

It should be noted that detection signals from the above described sensors are input to the control unit 5.

A detailed description will now be given of the intermediate transfer section.

The intermediate transfer member 30 is made of PET (polyethylene terephthalate) or PVDF (polyvinylidene fluoride), for example.

The intermediate transfer member 30 is supported by the driving roller 32, the tension roller 33, and the driven roller 34.

The driving roller 32 is formed of a metal roller having the surface thereof coated with rubber (urethane rubber or chloroprene rubber) of a thickness of several millimeters to prevent the driving roller 32 from slipping on the intermediate transfer conveying belt 30.

The driving roller 32 is rotatively driven by a stepping motor, not shown.

The primary transfer rollers 35*a* to 35*d* are arranged on the reverse side of the intermediate transfer member 30 at locations where the photosensitive drums 11*a* to 11*d* are opposed to the intermediate transfer member 30.

The secondary transfer roller 36 is opposed to the driven roller 34, and forms a secondary transfer region by a nip between the secondary transfer roller 36 and the intermediate transfer member 30.

The secondary transfer roller 36 is pressurized against the intermediate transfer member 30 with an appropriate force.

The cleaning device 50 is disposed downstream of the secondary transfer region on the intermediate transfer member 30, and is comprised of the cleaning blade 51, and the waste toner box 52.

The fixing unit 40 is comprised of the fixing roller 41*a*, the pressurizing roller 41*b*, the first sheet discharging roller 44, and the first discharged sheet sensor 68.

On the other hand, the sheet material P conveyed to the pair of registration rollers 25 on the conveying path is temporarily stopped from being conveyed by stopping rotating the rollers upstream of the pair of registration rollers 25, and is restarted to be conveyed by starting rotating the upstream rollers including the pair of registration rollers 25.

The sheet material P is fed to the secondary transfer region.

In the secondary transfer region, the image on the intermediate transfer member 30 is transferred onto the sheet material P, then the transferred images are fixed by the fixing unit 40, and then the sheet material P passes through the first sheet discharging roller 44. Thereafter, the destination of the sheet material P is selectively switched to the face-up discharged sheet tray 2 or to the face-down discharged sheet tray 3 by the switching flapper 73.

If the switching flapper 73 is in a face-up sheet discharging position, the sheet material P is discharged to the face-up discharged sheet tray 2 by the pair of second sheet discharging rollers 45.

On the other hand, if the switching flapper is in a face-down sheet discharging position, the sheet material P is conveyed to the pairs of inversion rollers 72*a*, 72*b*, and 72*c* and then discharged to the face-down discharged sheet tray 3.

In the case where images are formed on both sides of the sheet material P, the sheet material P is conveyed toward the face-down discharged sheet tray 3, and when the trailing end of the sheet material P reaches an inverting location R, the conveyance of the sheet material P is stopped, and the rotational direction of the pairs of inversion rollers 72*a* to 72*c* is reversed to a direction toward the pairs of double-sided sheet refeed rollers 74*a* to 74*d*. Then, the sheet material P is conveyed in the reverse direction, and then the sheet material P is conveyed to the secondary transfer roller 3 as in the case where the sheet material P is conveyed from any of the cassettes 21*a* to 21*d*.

It should be noted that on the conveying path for the sheet material P are arranged a plurality of sensors for detecting the passage of the sheet material P, such as the sheet feed pre-registration sensors 64*a* to 64*d*, the deck sheet feed sensor 65, the deck drawing sensor 66, the registration sensor 67, the first discharged sheet sensor 68, the face-down discharged sheet sensor 69, the double-sided pre-registration sensor 70, and the double-sided sheet refeed sensor 71.

Further, the cassette sheet detecting sensors 63*a* to 63*d* for detecting the sheet material P are arranged in the respective cassettes 21*a* to 21*d* that store the sheet materials P, and the manual feed tray sheet detecting sensor 76 for detecting the presence of the sheet material P on the manual feed tray 27 is disposed in the manual feed tray 27, and the deck sheet detecting sensor 75 for detecting the presence of the sheet material P in the deck 28 is disposed in the deck 28.

The operating section 4 is disposed on an upper surface of the image forming apparatus 1, and enables selection of any sheet feed section in which the sheet material P is stored (the sheet feed cassettes 21*a* to 21*d*, the manual feed tray 27, or the deck 28), selection of any discharged sheet tray (the face-up discharged sheet tray 2 or the face-down discharged sheet tray 3), designation of a tab sheet bundle, and so forth.

A description will now be given of the electrical configuration of the control unit 5 with reference to FIG. 2.

The control unit 5 is comprised of the CPU 501 as a controller, a ROM 502, a RAM 503, the solenoid 504, the sheet feed motor 505, and the registration motor 506 as a registration means for rotating the pair of registration rollers 25.

The control unit 5 includes a control substrate, not shown, for controlling the operation of mechanisms in the above described component parts, and a motor drive substrate, not shown.

FIG. 2 is a block diagram showing essential parts of the image forming apparatus 1 according to the present embodiment.

The CPU 501 controls the overall operation of the image forming apparatus 1, and provides various kinds of control as described below.

The ROM 502 store programs which are executed by the CPU 501 to provide control, and the RAM 503 store temporary data required for control. Such programs and data are read out by the CPU 501 as the need arises.

The CPU 501 has a plurality of timers incorporated therein, one of which counts BD signal pulses to generate a predetermined timing signal.

Further, another timer counts internal clocks of the CPU 501 to generate a predetermined timing signal.

Further, the CPU 501 generates an image formation start signal.

In response to output of the image formation start signal, image exposure is started.

When a predetermining number of BD signal pulses have been counted after the start of image exposure, the CPU 501 drives the registration motor 506 to rotate the pair of registration rollers 25.

On the other hand, the CPU 501 provides control to start conveying the sheet material P upon the lapse of an appropriate period of time after the start of image exposure such that the conveyance of the sheet material P is started in time for the start of rotation of the registration rollers 25. This makes it possible to synchronize the start of image exposure and the start of conveyance of the sheet material P.

In the present embodiment, each of the registration motor 506 and the sheet feed motor 505 is implemented by a stepping motor.

A description will now be given of how the conveyance of the sheet material P is controlled by the image forming apparatus 1 appearing in FIG. 1 with reference to a timing chart of FIG. 3.

Here, an example where the sheet material P is conveyed from the cassette 21*a* will be described.

Figure 3:
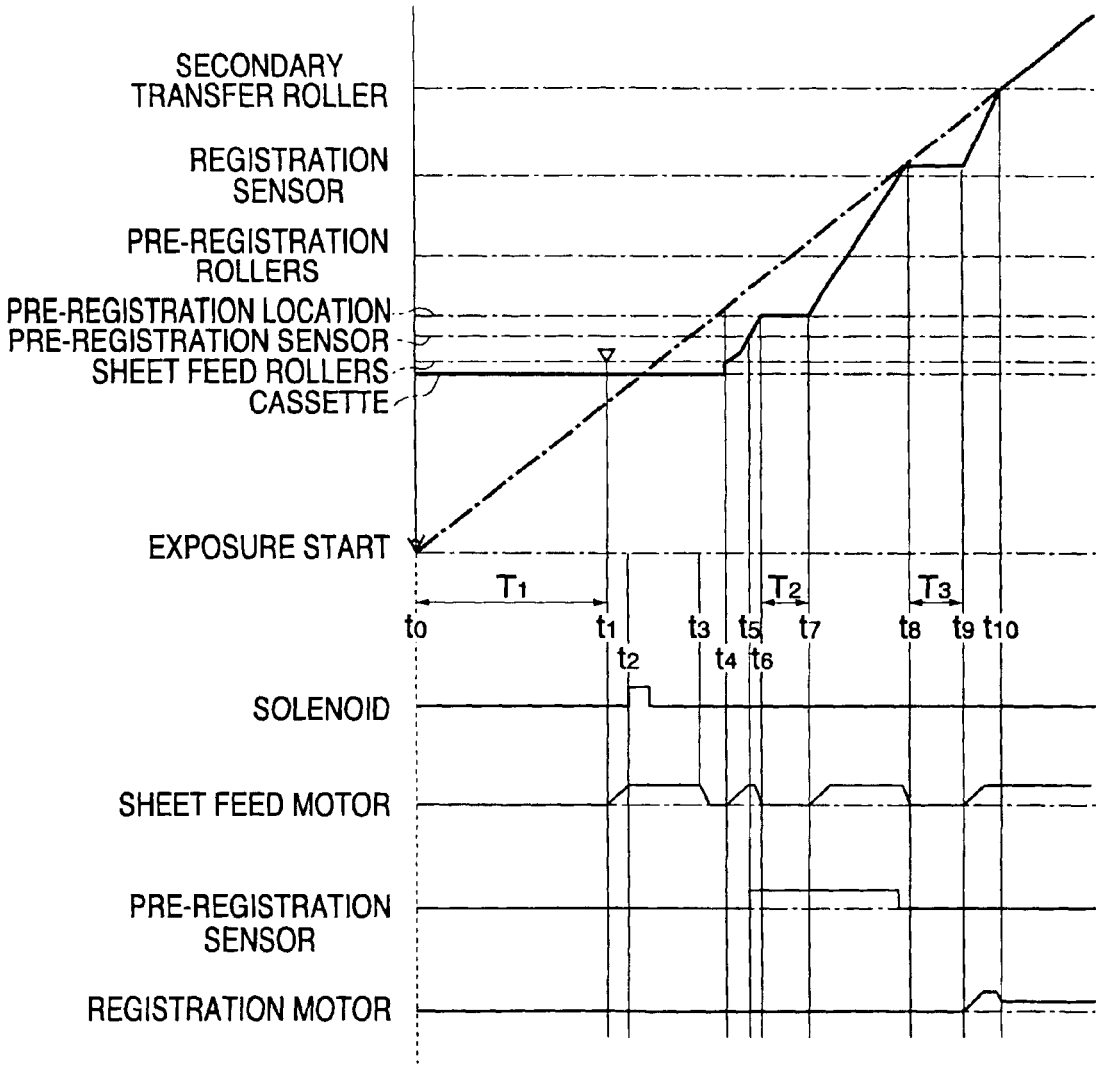
FIG. 3 is a timing chart showing a sequence of control for conveying a sheet material P, which is executed by the image forming apparatus 1 in FIG. 1.

In FIG. 3, the vertical axis represents the distance, and the horizontal axis represents the time.

The solid line in FIG. 3 indicates how the leading end of the sheet material P is fed from the cassette 21*a* to the secondary transfer roller 36 via the pair of registration rollers 25 as the time goes on.

Further, the triangular symbol ▽ indicates timing t1 in which the conveyance of the sheet material P is started, and the origin indicates timing t0 in which image exposure on the photosensitive drum 11*d* is started.

Upon the lapse of a period of time T1 after issuance of the image formation start signal in the timing t0, that is, in the timing t1, the CPU 501 causes the sheet feed motor 505 to start rotating.

When the sheet feed motor 505 has come to rotate at a predetermined speed, the CPU 501 causes the solenoid 504 to operate in timing t2.

The operation of the solenoid 504 causes the pick-up roller 22*a* to start moving down due to the cooperation of the cam and the gear.

The CPU 501 causes the sheet feed motor 505 to temporarily stop in timing t3 in which the pick-up roller 22*a* comes into contact with the sheet material P stored in the cassette 21*a*, and then causes the sheet feed motor 505 to rotate in timing t4.

The pick-up roller 22*a* then feeds the sheet materials P from the cassette 21*a* toward the pair of sheet feed rollers 23*a*.

The pair of sheet feed rollers 23*a* then divide the sheet materials P sheet by sheet, so that the sheet materials P can be conveyed sheet by sheet.

In timing t5 in which the pre-registration sensor 64*a* detects the leading end of the sheet material P, the conveyance of the sheet material P is started to convey the sheet material P to a predetermined pre-registration location downstream of the pair of drawing rollers 24*a*, and when the sheet material P reaches the pre-registration location, the CPU 501 causes the sheet feed motor 505 to temporarily stop (timing t6), and causes the sheet material P to wait for a first waiting time T2.

In timing t7 in which the first waiting time T2 has elapsed, the CPU 501 drives the sheet feed motor 505 to restart conveying the sheet material P toward the pair of registration rollers 25.

When the registration sensor 67 detects the leading end of the sheet material P, the CPU 501 provides control to convey the sheet material P by a predetermined distance, so that the sheet material P is made to abut on the pair of registration rollers 25 in timing t8. On this occasion, the sheet material P reaches a registration location to form the loop L (refer to FIG. 1). The CPU 501 then provides control to stop rotating the sheet feed motor 505 and cause the sheet material P to wait for a second waiting time T3.

In timing t9 synchronous with the issuance of the image formation start signal upon the lapse of the second waiting time T3, the registration motor 506 is rotated to restart conveying the sheet material P, so that the sheet material P reaches the secondary transfer roller 36 (in timing t10).

It should be noted that in the period of time from the timing t9 to the timing t10, the sheet feed motor 505 and the registration motor 506 are controlled to rotate at a sheet feeding/conveying speed until the sheet material P reaches the secondary transfer roller 36, and to rotate at an image forming speed immediately before the sheet material P reaches the secondary transfer roller 36.

On the other hand, when the image formation start signal is issued in the timing t0 in FIG. 3, image exposure is started on the photosensitive drum 11*d*, which is located at an upstream end in the rotational direction of the intermediate transfer member 30. Thereafter, image exposure is successively started on the photosensitive drums 11*c*, 11*b*, and 11*a* at respective time points delayed in accordance with the distance between the photosensitive drums.

Thereafter, toner images formed on the respective photosensitive drums 11*a* to 11*d* are primarily transferred onto the intermediate transfer member 30 in the respective primary transfer regions by the respective primary transfer rollers 35*a* to 35*d* with high voltages applied thereto. Therefore, the next toner images can be transferred in a manner corresponding to the previous images.

In this way, finally, four-color toner images are primarily transferred onto the intermediate transfer member 30.

Thereafter, a high voltage is applied to the secondary transfer roller 36 in timing with passage of the sheet material P through the secondary transfer roller 36, and in the timing t10, the transfer of the four-color toner images formed on the intermediate transfer conveying belt 30 onto the surface of the sheet material P is started.

The one-dot chain line in FIG. 3 indicates the relationship between the distance and the time over which the leading end of the sheet material P moves.

Referring next to a flow chart of FIG. 4, a description will be given of a process in which the first waiting time T2 and the second waiting time T3 appearing in FIG. 3 are determined. This process is executed by the CPU 501 of the control unit 5 appearing in FIG. 2.

In the following description, it is assumed that T represents a period of time which is estimated to be required for conveying the sheet material P from the pre-registration sensor (e.g. 64*a*, 64*b*; hereinafter referred to as 64*a*) to the location of the registration rollers 25 without being temporarily stopped, Ts, a period of time required for stopping or starting the sheet feed motor 505, α, an ideal arrival time point at which the sheet material P reaches the registration roller location (the timing t8 appearing in FIG. 3), which is set to a predetermined time point, β, a time point at which the registration motor 506 starts to be driven, Tα, a period of time from a time point A at which the registration sensor 64*a* turns on due to detection of the leading end of the sheet material P to the time point α, and Tβ, a period of time from the time point A at which the registration sensor 64*a* turns on due to detection of the leading end of the sheet material P to the time point β.

First, in a step S401, the CPU 501 starts controlling the conveyance of the sheet material P. This corresponds to the timing t1 appearing in FIG. 3.

The process then proceeds to a step S402 wherein the turning-on of the pre-registration sensor 64*a* is awaited.

When the pre-registration sensor 64*a* turns on, the process proceeds to a step S403 wherein the CPU 501 reads out the present time. The present time represents a count value of the timer that counts BD signal pulses.

The process then proceeds to a step S404 wherein the estimated time period T before the pair of registration rollers is reached and the motor starting/stopping time period Ts are added together to find a time period T+Ts, which is then stored in the RAM 503.

The process then proceeds to a step S405 wherein the time period T+Ts and the time period Tα are compared with each other. If the time period T+Ts is equal to or shorter than the time period Tα, the process proceeds to a step S406 wherein the CPU 501 provides control to temporarily stop the sheet material P at the pre-registration location and cause the sheet material P to wait for a time period Tα−(T+Ts).

Namely, the first waiting time T2 is set to the time period Tα−(T+T2).

The process then proceeds to a step S408 wherein the turning-on of the registration sensor 67 is awaited.

In the step S408, when the registration sensor 67 turns on, the process proceeds to a step S409 wherein the sheet material P is conveyed until it comes to abut on the pair of registration rollers 25. The process then proceeds to a step S410.

In the step S410, the CPU 501 provides control to stop rotating the sheet feed motor 505 and cause the sheet material P to wait for the second waiting time T3. Upon the lapse of the second waiting time T3, the CPU 501 provides control to start driving the registration motor 506 in the timing t9, followed by termination of the present process.

It should be noted that the second waiting time T3 is a period of time from the time point the sheet material P comes to abut on the pair of registration rollers 25 to the registration motor 506 drive starting time point β, and varies according to which of the step S406, a step S411, or a step S412, described later, has been executed.

On the other hand, if it is determined in the step S405 that the time period T+Ts is longer than the time period Tα, the process proceeds to a step S407.

In the step S407, the time period T+Ts and the time period Tβ are compared with each other. If the time period T+Ts is shorter than the time period Tβ, the process proceeds to the step S411 wherein the CPU 501 causes the sheet material P to temporarily stop at the pre-registration location and to wait for the time period Ts.

Namely, the first waiting time T2 is set to the time period Ts.

Thereafter, the conveyance of the sheet material P is restarted, and the process then proceeds to the step S408 wherein the turning-on of the registration sensor 67 is awaited.

If it is determined in the step S407 that the time period T+Ts is equal to or longer than the time period Tβ, the process proceeds to the step S412.

In the step S412, the time period T and the time period Tβ are compared with each other. If the time period T is longer than the time period Tβ, the sheet material P cannot be conveyed in time for the timing β in which the registration motor 506 starts to be driven, even if the sheet material P is conveyed as it is. Therefore, the process proceeds to a step S413 wherein the CPU 501 determines that an abnormality occurs and performs abnormality eliminating processing, such as suspending the conveyance of the sheet material P, and notifying the user of the abnormality via the operating section 4. The process is then terminated.

If the time period T is equal to or shorter than the time period Tβ, that is, the sheet material P can be conveyed in time for the motor drive starting point β if the sheet material P is conveyed as it is, the CPU 501 causes the sheet material P to continue to be conveyed without being temporarily stopped at the pre-registration location, that is, without waiting for the first waiting time T2. The process then proceeds to the step S408.

A detailed description will now be given of the processing in the steps S405, S407, and S412 appearing in FIG. 4 with reference to FIGS. 5 to 7.

Figure 5:
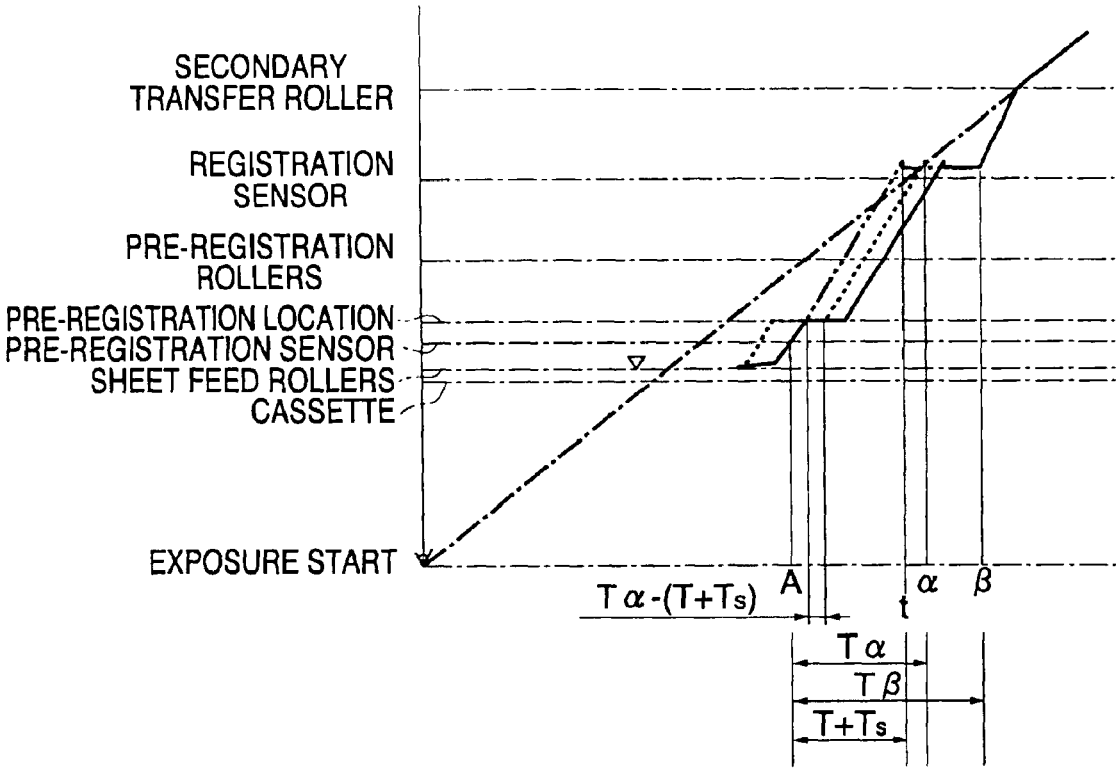
FIG. 5 is a flow chart showing an example of control operation according to the waiting time determining process in FIG. 4.
Figure 6:
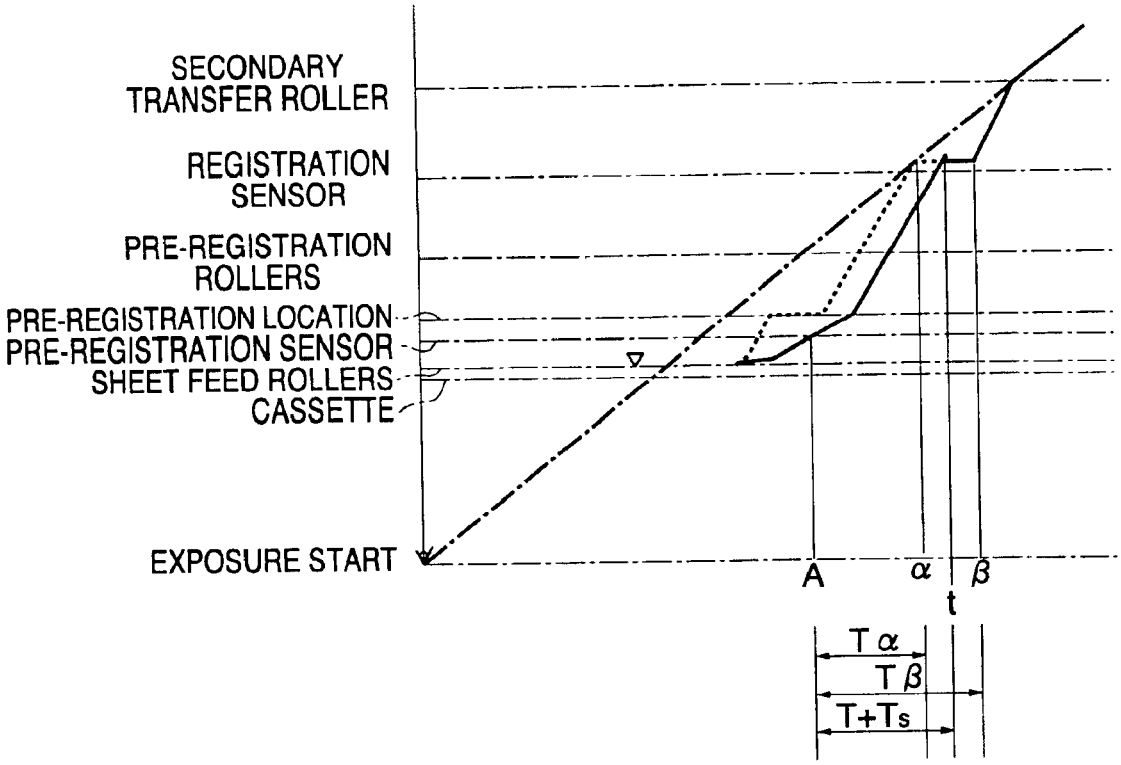
FIG. 6 is a flow chart showing another example of control operation according to the waiting time determining process in FIG. 4.
Figure 7:
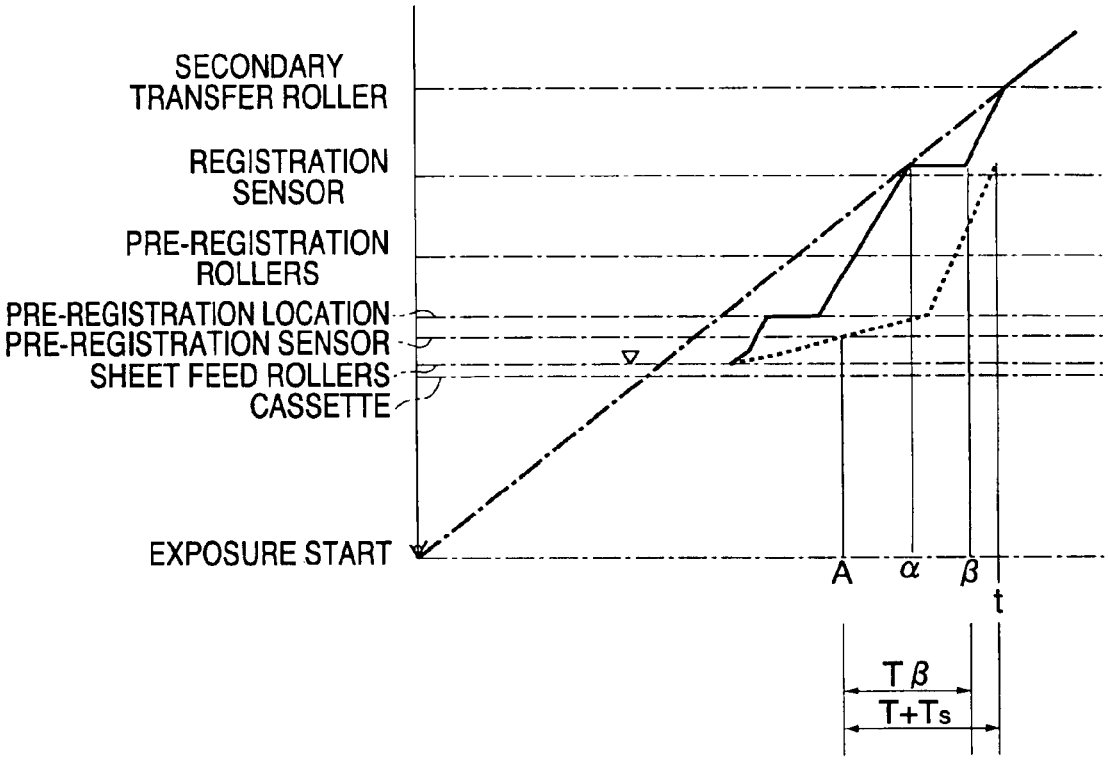
FIG. 7 is a flow chart showing still another example of control operation according to the waiting time determining process in FIG. 4.
Figure 8A:
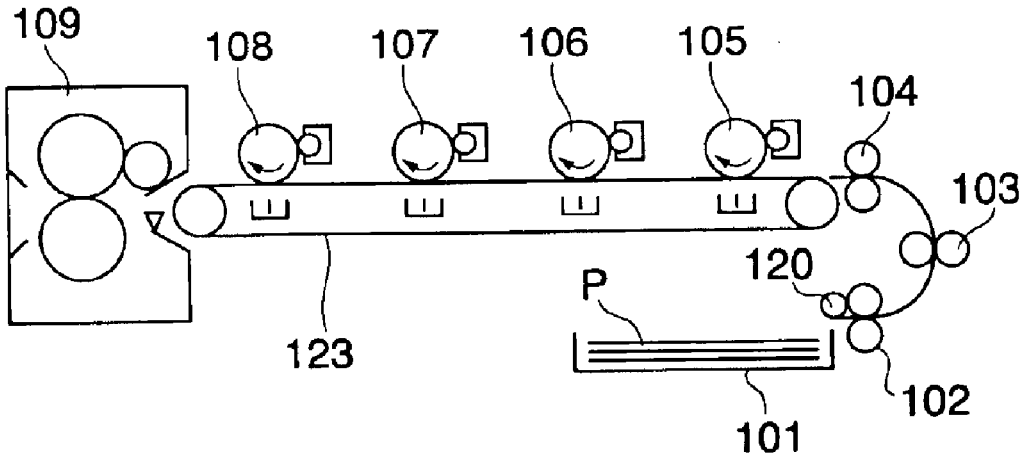
FIG. 8A is a view schematically showing an example of a conventional image forming apparatus.
Figure 8B:
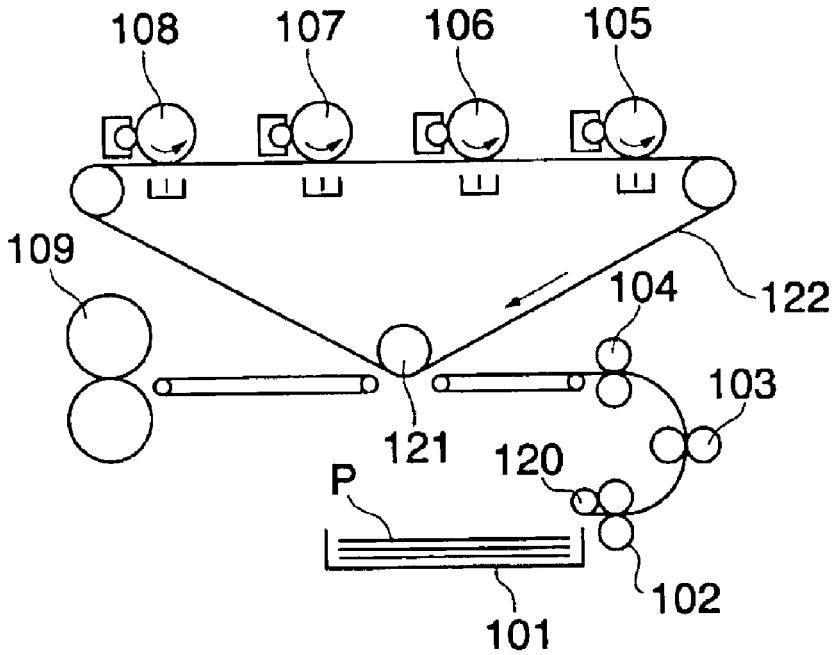
FIG. 8B is a view schematically showing an example of another conventional image forming apparatus.

In FIGS. 5 to 7, A represents a time point at which the pre-registration sensor 64*a* turns on, and t represents a time point at which the period of time calculated by adding together the estimated time period T before the pair of registration rollers is reached and the motor starting/stopping time period Ts has elapsed after the time point A.

The broken lines in FIG. 5 to 7 indicate how the leading end of the sheet material P moves when it is conveyed in an ideal manner without delay.

Similarly to FIG. 3, the triangular symbol ▽ represents a conveyance starting time point, and the one-dot chain line indicates the movement of the leading end of the sheet material P.

Figure 4:
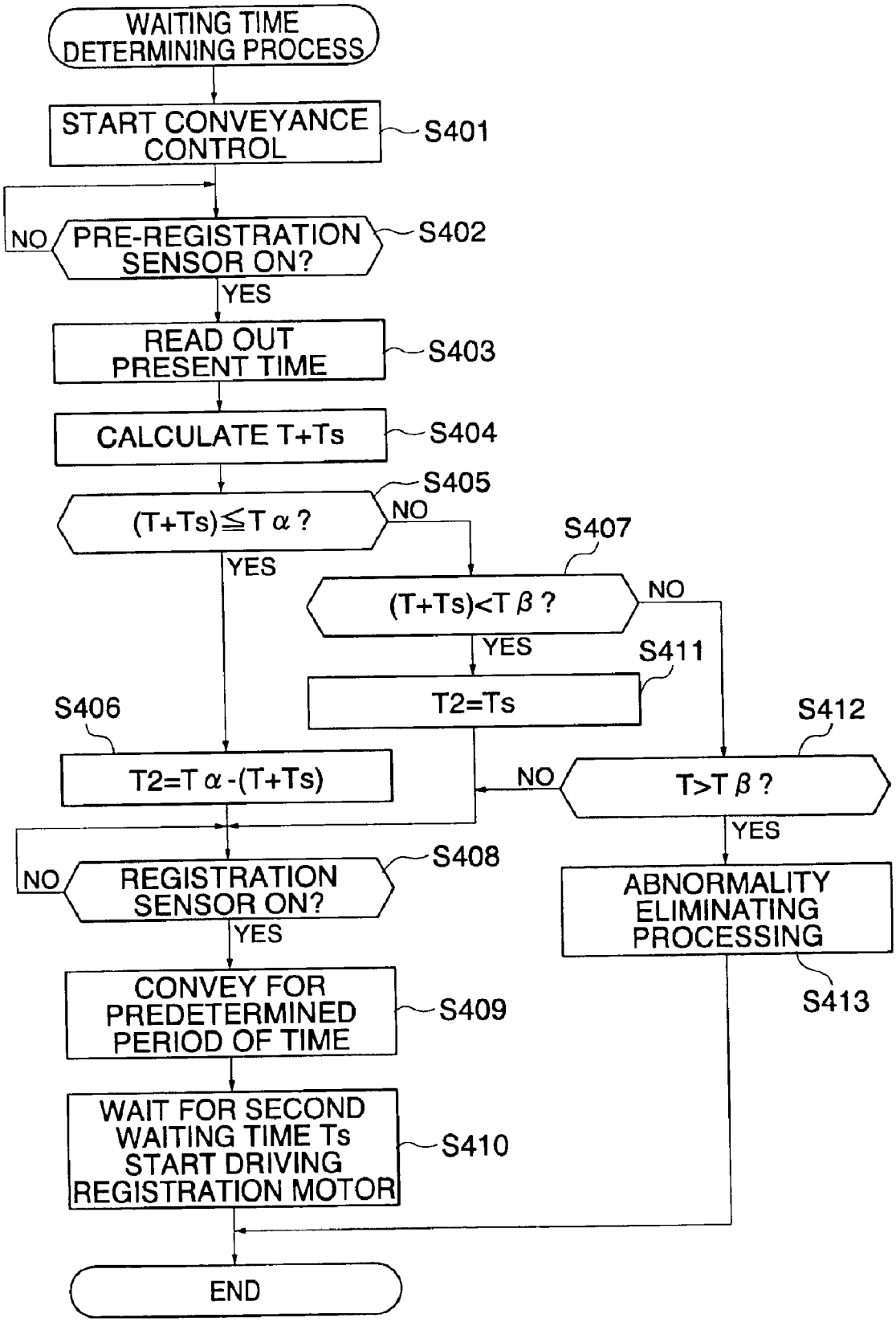
FIG. 4 is a flow chart showing a waiting time determining process for determining a first waiting time T2 and a second waiting time T3.

First, a description will be given of how the CPU 501 provides control in the case where the determination result in the step S405 in FIG. 4 is positive (YES).

In the step S405, the motor starting/stopping time period Ts is added to the estimated time period T before the pair of registration rollers is reached to find the time period T+Ts, and the time period T+Ts and the time period Tα are compared with each other.

If, as indicated by the two-dot chain line in FIG. 5, the time period T+Ts is shorter than the time period α (i.e. the determination result in the step S405 is positive (YES)), if the sheet material P is conveyed to the registration rollers 25 without being temporarily stopped, the leading end of the sheet material P being conveyed may come into contact with the trailing end of the immediately preceding conveyed sheet material P.

Further, if the sheet material P waits at the pre-registration location for an excessively long period of time, the sheet material P cannot be conveyed in time for the arrival time point α as indicated by the solid line in FIG. 5 (however, there is no adverse effect on image formation on the sheet material P insofar as a time point at which the registration sensor 67 turns on is not later than the motor drive starting time point β).

In such a case, the CPU 501 causes the sheet material P to wait at the pre-registration location for the period of time Tα−(T+Ts) (step S406 in FIG. 4). Referring next to FIG. 6, a description will be given of how the CPU 501 provides control in the case where the determination result in the step S405 is negative (NO) and the determination result in the step S407 is positive (YES).

As indicated by the solid line in FIG. 6, there may be a case where after the conveyance of the sheet material P is started, there is a delay in conveyance of the sheet material P relative to the ideal conveyance due to such factors as the wear of the rollers and the material of the sheet material P so that the pre-registration sensor 64*a* turns on in delayed timing (at the time point A in FIG. 6, for example).

In this case as well, the time period T+Ts is calculated by adding the motor starting/stopping time period Ts to the estimated time period T before the pair of registration rollers is reached (step S404), and the time period T+Ts and the time period Tα are compared with each other (step S405).

This is because, in the case where the time period T+Ts is equal to or shorter than the time period Tα ("YES" in the step S405 in FIG. 4), if the sheet material P is conveyed to the registration rollers 25 without being temporarily stopped, the leading end of the sheet material P being conveyed may come into contact with the trailing end of the immediately preceding conveyed sheet material P.

In the example indicated by the solid line in FIG. 6, if the time period T+Ts and the time period Tα are compared with each other, the time period T+Ts is longer than the time period Tα ("NO" in the step S405 in FIG. 4) but is shorter than the time period Tβ ("YES" in the step S407 in FIG. 4). Therefore, the CPU 501 causes the sheet material P to wait at the pre-registration location for the time period Ts (which is short and hence is not illustrated in FIG. 6).

In this case, the conveyance of the sheet material P from the pre-registration location is started behind the ideal starting time, but the sheet material P never comes into contact with the trailing end of the immediately preceding conveyed sheet material P, and can be conveyed in time for the motor drive starting time point β for the registration motor 506.

Referring next to FIG. 7, a description will be given of how the CPU 501 provides control in the case where the determination result in the step S405 is negative (NO), the determination result in the step S407 is negative (NO), and the determination result in the step S412 is positive (YES).

As indicated by the broken line in FIG. 7, there may be a case where after the conveyance of the sheet material P is started, there is a delay in conveyance of the sheet material P relative to the ideal conveyance due to such factors as the wear of the rollers and the material of the sheet material P so that the pre-registration sensor 64*a* turns on in delayed timing (at the time point A in FIG. 7, for example).

In the example indicated by the broken line in FIG. 7, if the time period T+Ts and the time period Tα are compared with each other, the time period T+Ts is longer than the time period Tα ("NO" in the step S405 in FIG. 4), and further, if the time period T+Ts and the time period Tβ are compared with each other, the time period T+Ts is longer than the time period Tβ ("NO" in the step S407 in FIG. 4).

In such a case, the estimated conveyance time period T and the time period Tβ are compared with each other (step S412).

In the example illustrated in FIG. 7, if the estimated conveyance time period T and the time period Tβ are compared with each other, the estimated conveyance time period T is longer than the time period Tβ ("YES" in the step S412), and hence, even if the sheet material P is conveyed to the registration rollers 25 without being temporarily stopped, the sheet material P cannot be conveyed in time for the motor drive starting point β for the registration motor 506.

Therefore, in this case, the CPU 501 determines that there is an abnormality in conveyance, and suspends the conveyance of the sheet material P (step S413 in FIG. 4).

A description will now be given of how the CPU 501 provides control in the case where the determination result in the step S405 is negative (NO), the determination result in the step S407 is negative (NO), and the determination result in the step S412 is negative (NO).

Although not illustrated, there may be a case where if the time period T+Ts and the time period Tα are compared with each other, the time period T+Ts may be longer than the time period Tα ("NO" in the step S405), if the time period T+Ts and the time period Tβ are compared with each other, the time period T+Ts may be longer than the time Tβ ("NO" in the step S407), and if the estimated conveyance time period T and the time period Tβ are compared with each other, the estimated conveyance time period T is shorter than the time period Tβ ("NO" in the step S412).

In such a case, the sheet material P is conveyed to the registration rollers 25 without being temporarily stopped, so that the sheet material P can be conveyed in time for the motor drive starting time point β for the registration motor 506.

According to the process described above with reference to FIG. 4, by making determinations in the steps S405, S407, and S412, the sheet material P is caused to wait at the pre-registration location in the case where the sheet material P is conveyed to the pre-registration sensor 64*a* at an excessively high speed, in which case it would be determined according to the prior art that there is an abnormality in conveyance, and the period of time for which the sheet material P is caused to wait while abutting on the registration rollers 25 is decreased in the case where the sheet material P is conveyed to the pre-registration sensor 64*a* at an excessively low speed, and thus the margin of the image forming apparatus 1 for the conveyance abnormality can be enlarged.

Specifically, the conveyance of the sheet material P is controlled according to the timing in which the leading end of the sheet material P is detected and the timing in which the registration means starts to be driven in such a manner that the sheet material P is caused to wait at the pre-registration location when it is conveyed at an excessively high speed, and a delay in conveyance of the sheet material P is permitted to the maximum possible level within a range where leading end misalignment can be prevented when the sheet material P is conveyed at an excessively low speed, whereby the conveying latitude of the sheet material can be considerably improved as compared with the prior art.

As described above, according to the image forming apparatus 1 of the present embodiment, that is adapted to transfer toner images transferred onto the intermediate transfer member 30, onto the sheet material P, it is possible to reduce the possibility of leading end misalignment even if there is a delay in conveyance of the sheet material P.

In particular, in the case where there is a delay in the conveyance of the sheet material P to the pre-registration sensor, which would be regarded as a conveyance abnormality according to the prior art, the period of time for which the sheet material P is caused to wait while abutting on the registration rollers is decreased to thereby enlarge the margin of the image forming apparatus 1 for conveyance abnormality.

Therefore, the sheet material conveying performance of the image forming apparatus according to the present invention can be considerably improved as compared with the prior art.

It should be understood that the present invention is not limited to the embodiment described above, but various variations of the above described embodiment may be possible without departing from the spirits of the present invention.

What is claimed is:

1. An image forming apparatus comprising:

an image carrier that carries an image;

a transfer device that transfers the image carried by said image carrier onto a sheet;

a feeding device that feeds the sheet;

a conveying device that conveys the sheet fed by said feeding device to said transfer device; and a controller that controls said conveying device to cause the sheet to be temporarily stopped at a first location and a second location between said feeding device and said transfer device;

wherein said controller is operable when determining that, if the sheet is caused to be temporarily stopped at the first location, the sheet cannot be conveyed to said transfer device by said conveying device in time for timing in which the image carried by said image carrier reaches said transfer device, for providing control to inhibit the sheet from being temporarily stopped at the first location.

2. An image forming apparatus according to claim 1, wherein the second location is a registration location, and the first location is a pre-registration location upstream of the second location.

3. An image forming apparatus according to claim 1, comprising a sheet sensor disposed in a vicinity of the first location, and wherein said controller determines whether the sheet can be conveyed to said transfer device by said conveying device in time for the timing in which the image carried by said image carrier reaches said transfer device even if the sheet is caused to be temporarily stopped at the first location, based on timing in which said sheet sensor detects a leading end of the sheet.

4. An image forming apparatus according to claim 1, wherein said controller is operable when determining that the sheet cannot be conveyed to said transfer device by said conveying device in time for the timing in which the image carried by said image carrier reaches said transfer device even if the sheet is conveyed without being temporarily stopped at the first location, for providing control to stop conveyance of the sheet by said conveying device or issue abnormality warning.

5. An image forming apparatus comprising:

a photosensitive member;

an image forming device that forms an image on said photosensitive member;

an image carrier that carries an image;

a first transfer device that transfers the image formed on said photosensitive member onto said image carrier;

a second transfer device that transfers the image transferred onto said image carrier onto a sheet;

a feeding device that feeds the sheet;

a conveying device that conveys the sheet fed by said feeding device to said second transfer device; and a controller that controls said conveying device to cause the sheet to be temporarily stopped at a first location and a second location between said feeding device and said second transfer device;

wherein said controller is operable when determining that, if the sheet is caused to be temporarily stopped at the first location, the sheet cannot be conveyed to said second transfer device by said conveying device in time for timing in which the image carried by said image carrier reaches said second transfer device, for providing control to inhibit the sheet from being temporarily stopped at the first location.

6. An image forming apparatus according to claim 5, wherein the second location is a registration location, and the first location is a pre-registration location upstream of the second location.

7. An image forming apparatus according to claim 5, comprising a sheet sensor disposed in a vicinity of the first location, and wherein said controller determines whether the sheet can be conveyed to said second transfer device by said conveying device in time for the timing in which the image carried by said image carrier reaches said second transfer device even if the sheet is caused to be temporarily stopped at the first location, based on timing in which said sheet sensor detects a leading end of the sheet.

8. An image forming apparatus according to claim 5, wherein said controller is operable when determining that the sheet cannot be conveyed to said second transfer device by said conveying device in time for the timing in which the image carried by said image carrier reaches said second transfer device even if the sheet is conveyed without being temporarily stopped at the first location, for providing control to stop conveyance of the sheet by said conveying device or issue abnormality warning.

9. An image forming apparatus according to claim 5, wherein said photosensitive member comprises a photosensitive drum, and said image carrier comprises an intermediate transfer belt.

10. An image forming apparatus according to claim 5, wherein said photosensitive member comprises a plurality of photosensitive members.

* * * * *